US011060733B2

(12) United States Patent
Skovbo et al.

(10) Patent No.: US 11,060,733 B2
(45) Date of Patent: Jul. 13, 2021

(54) COMBI STOVE AND USE OF A COMBI STOVE

(71) Applicant: ADURO A/S, Hasselager (DK)

(72) Inventors: Christian Skovbo, Aarhus (DK); Kim Gregersen, Brønderslev (DK)

(73) Assignee: Aduro A/S, Hasselager (DK)

( * ) Notice: Subject to any disclaimer, the term of this patent is extended or adjusted under 35 U.S.C. 154(b) by 146 days.

(21) Appl. No.: 16/465,169

(22) PCT Filed: Dec. 18, 2017

(86) PCT No.: PCT/DK2017/050435
§ 371 (c)(1),
(2) Date: May 30, 2019

(87) PCT Pub. No.: WO2018/113880
PCT Pub. Date: Jun. 28, 2018

(65) Prior Publication Data

US 2019/0338954 A1 Nov. 7, 2019

(30) Foreign Application Priority Data

Dec. 20, 2016 (DK) ..... PA 2016 71006

(51) Int. Cl.
*F24B 13/04* (2006.01)
*F23B 40/04* (2006.01)
(Continued)

(52) U.S. Cl.
CPC ..... *F24B 13/04* (2013.01); *F23B 40/04* (2013.01); *F23C 1/06* (2013.01); *F24B 1/024* (2013.01);
(Continued)

(58) Field of Classification Search
CPC ..... F24B 13/04; F24B 13/004; F24B 1/024; F24B 1/195; F24B 1/1802; F23B 40/04;
(Continued)

(56) References Cited

U.S. PATENT DOCUMENTS 3,842,821 A * 10/1974 Juris ..... F24B 1/1802 126/512
4,598,653 A * 7/1986 Stringfellow ..... F23B 1/36 110/245
(Continued)

FOREIGN PATENT DOCUMENTS

DE 10254565 A1 6/2004
DE 102005049276 A1 4/2007
(Continued)

OTHER PUBLICATIONS

"EP_2500650_A2_M—Machine Translate.pdf", machine translation, epo.org, Dec. 18, 2020.*
(Continued)

*Primary Examiner* — Steven B McAllister
*Assistant Examiner* — Daniel E. Namay
(74) *Attorney, Agent, or Firm* — Blank Rome LLP

(57) ABSTRACT

A combi stove (1) is arranged for combusting both logs and granular material. The combi stove (1) has a common combustion chamber (2) arranged so that both the logs and the granular material may be combusted in the common combustion chamber (2). The combi stove (1) further has an ash collector (3) arranged under the combustion chamber (2) and a front aperture (4) through which logs may be placed in the combustion chamber (2). Also the combi stove (1) includes a granular material combustion area (5) arranged in the combustion chamber (2), wherein the granular material combustion area (5) has a bottom combustion surface (6) including bottom airflow apertures (7) arranged to enable an
(Continued)

Figure 2:
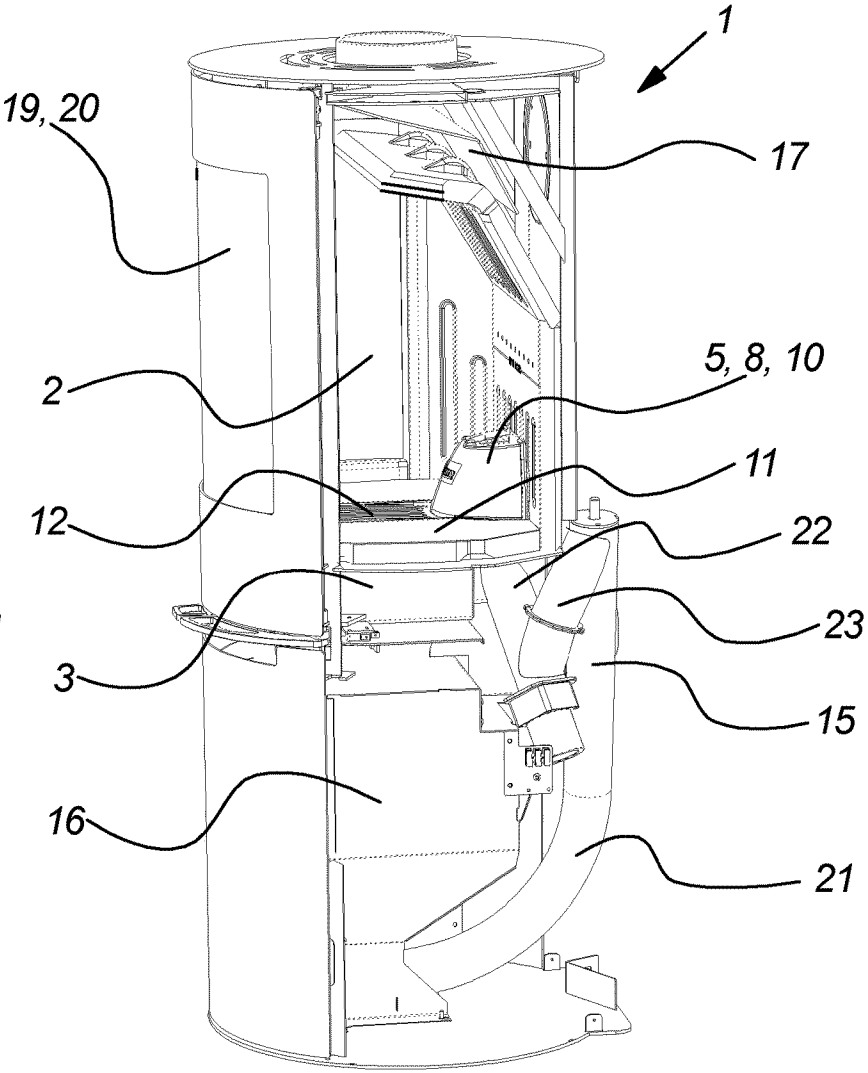

airflow to the granular material during a combustion of the granular material in the granular material combustion area (5). The granular material combustion area (5) is at least partly surrounded by a granular material area sidewall (8) having sidewall airflow apertures (9) arranged to enable an airflow to flue gasses generated during a combustion of the granular material in the granular material combustion area (5). At least a part of the granular material area sidewall (8) is releasable from the granular material combustion area (5). Furthermore, a use of a combi stove (1).

16 Claims, 4 Drawing Sheets

(51) Int. Cl.

| | |
|---|---|
| ***F24B 1/02*** | (2006.01) |
| ***F24B 1/195*** | (2006.01) |
| ***F23C 1/06*** | (2006.01) |
| ***F24C 1/04*** | (2021.01) |
| ***F24B 13/00*** | (2006.01) |
| *F25B 13/00* | (2006.01) |

(52) U.S. Cl.
CPC ..... *F24B 1/195* (2013.01); *F24B 13/004* (2013.01); *F24C 1/04* (2013.01); *F23B 2900/00001* (2013.01)

(58) Field of Classification Search
CPC .... F23B 2900/00001; F23C 1/06; F23C 1/04; F23C 2700/06
USPC ..... 126/73, 111, 283
IPC ..... F24B 13/04,13/00, 1/02, 1/18, 1/195, 1/197; F24C 1/02, 1/04; F23B 40/04 ; F23C 1/06
See application file for complete search history.

(56) References Cited

U.S. PATENT DOCUMENTS

| | | | | |
|---|---|---|---|---|
| 5,137,012 | A * | 8/1992 | Crossman, Jr. | F24B 1/024 110/110 |
| 6,336,449 | B1 * | 1/2002 | Drisdelle | F24B 1/024 126/73 |
| 2014/0305357 | A1 * | 10/2014 | DeSellem | F23C 1/04 110/347 |
| 2016/0209042 | A1 * | 7/2016 | Yu | F24C 1/02 |
| 2016/0327263 | A1 * | 11/2016 | Traeger | F24C 1/04 |
| 2017/0082292 | A1 * | 3/2017 | Amlin | F24B 13/02 |
| 2019/0390853 | A1 * | 12/2019 | Skovbo | F23H 13/02 |

FOREIGN PATENT DOCUMENTS

| | | | | |
|---|---|---|---|---|
| EP | 1455136 | A1 | 9/2004 | |
| EP | 2103872 | A1 | 9/2009 | |
| EP | 2386799 | A1 | 11/2011 | |
| EP | 2500650 | A2 | 9/2012 | |
| FR | 2713748 | A1 * | 6/1995 | F23Q 7/02 |
| FR | 2995666 | A1 | 3/2014 | |
| JP | 2016-006366 | A | 1/2016 | |
| KR | 20180086117 | A * | 7/2018 | |

OTHER PUBLICATIONS

"DE_10254565_B4_M—Machine Translate.pdf", machine translation, epo.org, Dec. 18, 2020.*
International Search Report & Written Opinion for PCT/DK2017/050435, dated Apr. 9, 2018, 12 pages.
International Preliminary Report on Patentability for PCT/DK2017/050435, dated Nov. 22, 2018, 5 pages.

* cited by examiner

COMBI STOVE AND USE OF A COMBI STOVE

RELATED APPLICATIONS

This application is a national phase of PCT/DK2017/050435, filed on Dec. 18, 2017, which claims priority to Denmark Patent Application No. PA 2016 71006, filed on Dec. 20, 2016. The entire contents of these applications are hereby incorporated by reference.

FIELD OF THE INVENTION

The invention relates to a combi stove arranged for combusting both logs and granular material. The combi stove comprises a common combustion chamber arranged so that both the logs and the granular material may be combusted in the common combustion chamber. The invention further relates to use of a combi stove.

BACKGROUND OF THE INVENTION

Pellet stoves are becoming more and more popular because the uniform combustion material (typically wood pellets) enables a more uniform, controllable, efficient and cleaner combustion.

However, a pellet stove has two major drawbacks in relation to conventional wood burning stoves—in which wood logs or briquettes are the primary combustion material. A pellet stove requires electricity to initiate the combustion process, to feed pellets to the combustion area, to actively generate an airflow to the combustion area etc. so a pellet stove cannot (or is at least very difficult to) operate without electricity. Furthermore, the pellet combustion process is typically noisier—noise being generated by the active airflow, the pellet feeding system or other—and the combustion process in a pellet stove is typically not at pleasing and calming to watch as a combustion process in a wood burning stove.

Thus, combi stoves capable of using both wood logs and pellets as combustion material have been developed. E.g. from the German patent DE 10 2005 049 276 B4 it is known to design a common household stove so that it may use both pellets and logs as combustion material. But this design also entails difficult cleaning and maintenance.

It is therefore an object of the present invention to provide for a more maintenance and cleaning friendly combi stove.

THE INVENTION

The invention provides for a combi stove arranged for combusting both logs and granular material. The combi stove comprises a common combustion chamber arranged so that both the logs and the granular material may be combusted in the common combustion chamber. The combi stove further comprises ash collecting means arranged under the combustion chamber and a front aperture through which logs may be placed in the combustion chamber. Also the combi stove includes a granular material combustion area arranged in the combustion chamber, wherein the granular material combustion area comprises a bottom combustion surface including bottom airflow apertures arranged to enable an airflow to the granular material during a combustion of the granular material in the granular material combustion area, wherein the granular material combustion area is at least partly surrounded by a granular material area sidewall comprising sidewall airflow apertures arranged to enable an airflow to flue gasses generated during a combustion of the granular material in the granular material combustion area, and wherein at least a part of the granular material area sidewall is releasable from the granular material combustion area.

In a conventional pellet stove the granular material is usually combusted under the influence of a large and fast airflow to ensure complete and efficient combustion of granular material. However, in a combi stove a large and fast airflow would draw larger particles of ash and other out with the flue gas and thereby pollute the emission gas from the stove. Thus, in a combi stove the airflow directed to the bottom airflow apertures will have to be reduced in relation to an exclusive pellet stove. So to ensure that the gasses generated during the combustion in the granular material combustion area are substantially completely combusted, it is advantageous to also generate an airflow through the sidewall airflow apertures.

However, no matter how efficient the combustion process of the granular material runs, slag, cinder and to some degree also ash will have a tendency to build up in the burning pot of the granular material and it is therefore advantageous that the at least a part of the granular material area sidewall is releasable from the granular material combustion area so that the sidewall and/or the combustion area may easily be cleaned and maintained.

It should be emphasised that the term "log" is to be understood as any kind of larger wood piece, briquette, chopped wood or similar larger combustion material suited for being combusted in a wood burning stove. Although the term "log" is commonly used in relation with wood, the term is in this context not restricted entirely to wood, in that the log could be made from other combustible materials—either hole or compressed—such as other plant material, paper or cardboard material or other.

Furthermore, in this context the term "granular material" should be understood as any kind of pellet, grain, coarse or other a small particle material formed by wood, cereal, nut shells, paper or other or any combination thereof or any other kind of small particle material suitable for acting as combustion material in what is commonly known as a pellet stove.

Even further, in this context the term "ash collecting means" should be understood as any kind of ash collector suitable for collecting ash generated by the combustion processes in a combi stove—i.e. any kind of tray, salver, drawer, suction device or similar.

In an aspect of the invention, the common combustion chamber comprises a log combustion area and wherein the log combustion area is arranged between the front aperture and the granular material combustion area.

Forming the log combustion area in front of the granular material combustion area—as seen from the front aperture—is advantageous in that this will provide free space for arranging the logs in the combustion chamber and it will reduce the risk of the logs covering the granular material combustion area and thereby hinder the use or functionality of the granular material combustion.

In an aspect of the invention, the log combustion area is separated at least partly from the ash collecting means by means of a grate.

Separating at least a part of the log combustion area from the ash collecting means by means of a grate is advantageous in that only when combusted and turned into ash, the log combustion material can pass through the separation grate and the grate enables that air may flow freely to the combustion process from the underside.

In an aspect of the invention, the grate and the bottom combustion surface are substantially level.

Forming the stove so that the grate and the bottom combustion surface are substantially level is advantageous in that this enables that ash, slag or other on the bottom combustion surface may easily be swept or pushed out onto the grate where it will continue down into the ash collecting means.

It should be emphasised that the term "substantially level" in this context should not be limited to the grate and the bottom combustion surface being completely flush or even being parallel. In this context the term is to be understood as the grate and the bottom combustion surface being generally or roughly arranged in the same level, enabling that ash, slag or other on the bottom combustion surface may easily be moved out onto the grate.

In an aspect of the invention, a bottom part of the releasable part of the granular material area sidewall is arranged to engage the bottom combustion surface to substantially fix the granular material area sidewall against displacement in a horizontal plane.

Forming a bottom part of the sidewall so that it engages a corresponding part of the bottom combustion surface is advantageous in that it provides simple means of fixating the sidewall against displacement in the horizontal directions while at the same time allowing easy displacement in the vertical directions.

In an aspect of the invention, the releasable part of the granular material area sidewall is arranged to surround at least 20%, preferably 30% and most preferred 45% of the granular material combustion area.

If the releasable part of the sidewall is arranged to surround too much of the granular material combustion area the releasable part becomes more heavy and difficult to remove. However, if the releasable part of the sidewall is arranged to surround too little of the granular material combustion area it becomes difficult to access the granular material combustion area. Thus, the present size levels present an advantageous relationship between functionality and accessibility.

In an aspect of the invention, the sidewall airflow apertures are arranged at a top edge of the granular material area sidewall.

Forming the sidewall airflow apertures at the top edge of the sidewall is advantageous in that air hereby easily can be blown into the combustion gases to ensure efficient and complete combustion.

In an aspect of the invention, the combi stove comprises granular material feeding means arranged for feeding granular material up into the granular material combustion area from beneath the granular material combustion area during a combustion of the granular material in the granular material combustion area.

Feeding the granular material upwards into the granular material combustion area from below is advantageous in that this allows for a simpler design of the combustion chamber, it forms a more durable design because the granular material feeding means is more protected and it is avoided that dropping granular material and the granular material feeding means themselves will influence the combustion process compared to if the granular material was fed from above.

It should be emphasised that the term "granular material feeding means" in this context should be understood as any kind of granular material feeder suited for feeding granular material to a granular material combustion area—i.e. any kind of screw conveyer, auger, belt conveyer, chain conveyer or other or any combination thereof.

In an aspect of the invention, the combi stove comprises a granular material storage arranged beneath the combustion chamber.

Arranging the granular material storage beneath the combustion chamber provides for a compact and space-efficient stove design.

In an aspect of the invention, the combi stove comprises flue means arranged above the combustion chamber.

Arranging the flue means above the combustion chamber provides for a space and energy efficient stove design.

It should be emphasised that the term "flue means" in this context should be understood as any kind of flue suited for guiding the flue gases out of the stove while transferring the heat of the flue gasses to the stove—i.e. any kind of piping, flue maze, plate arrangement or other or any combination thereof.

In an aspect of the invention, the combi stove comprises airflow generating means for actively generating an airflow through the bottom airflow apertures and the sidewall airflow apertures at least during a combustion of the granular material.

Actively generating an airflow to the combustion area of the granular material is advantageous in that it hereby is possible to generate a more efficient and clean combustion.

It should be emphasised that the term "airflow generating means" in this context should be understood as any kind of airflow generator suited for actively generating an airflow—i.e. any kind of motor driven fan, blower, ventilation device or other or any combination thereof.

In an aspect of the invention, a top edge of the granular material area sidewall is formed with a non-uniform height over the bottom combustion surface.

Forming the top edge of the granular material area sidewall uneven is advantageous in that it hereby is more difficult to block the granular material combustion function of the stove by logs covering the granular material combustion area.

In an aspect of the invention, the granular material is wood pellets.

Wood pellets is an inexpensive, uniform and energy-rich material that is particularly suited as fuel in a combi stove according to the present invention.

The invention further provides for use of a combi stove according to any of the previously discussed combi stoves for combusting wood logs and wood pellets.

Wood logs and wood pellets are inexpensive substantially uniform combustion materials that are particularly suited as fuel in a combi stove according to the present invention.

FIGURES

Figure 1:
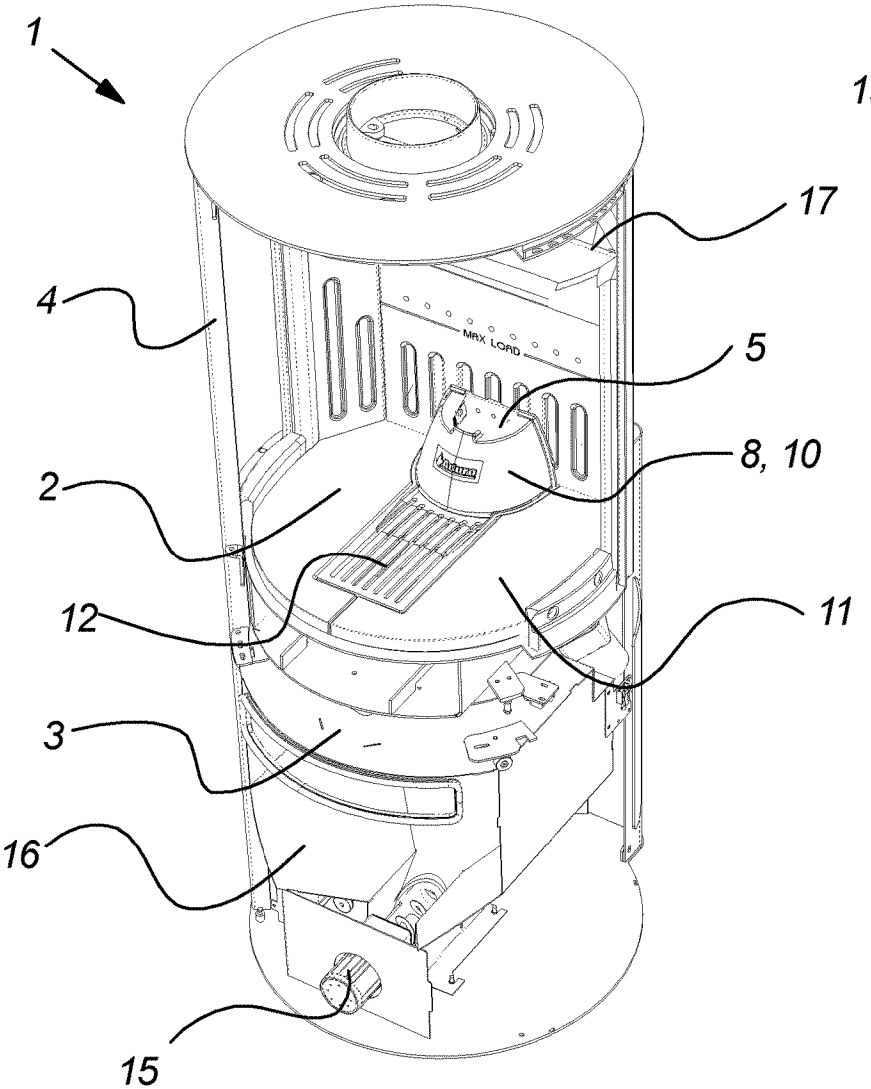
Figure 4:
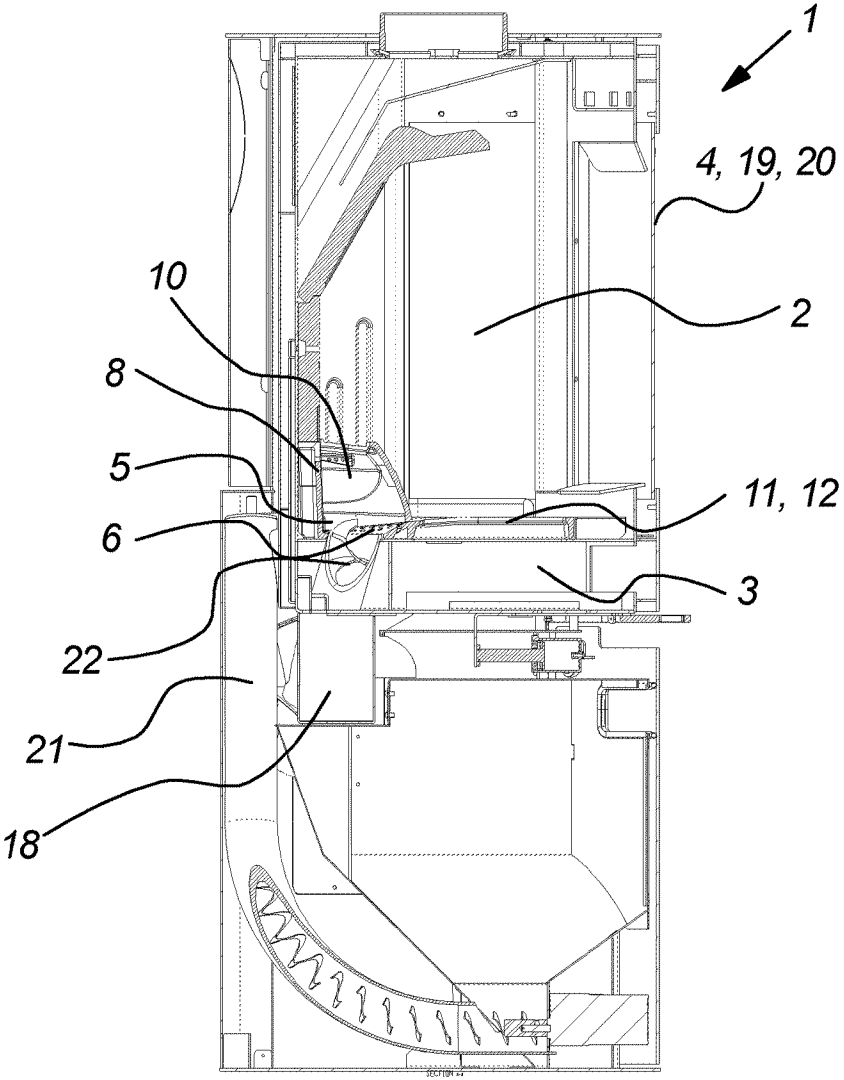
Figure 3:
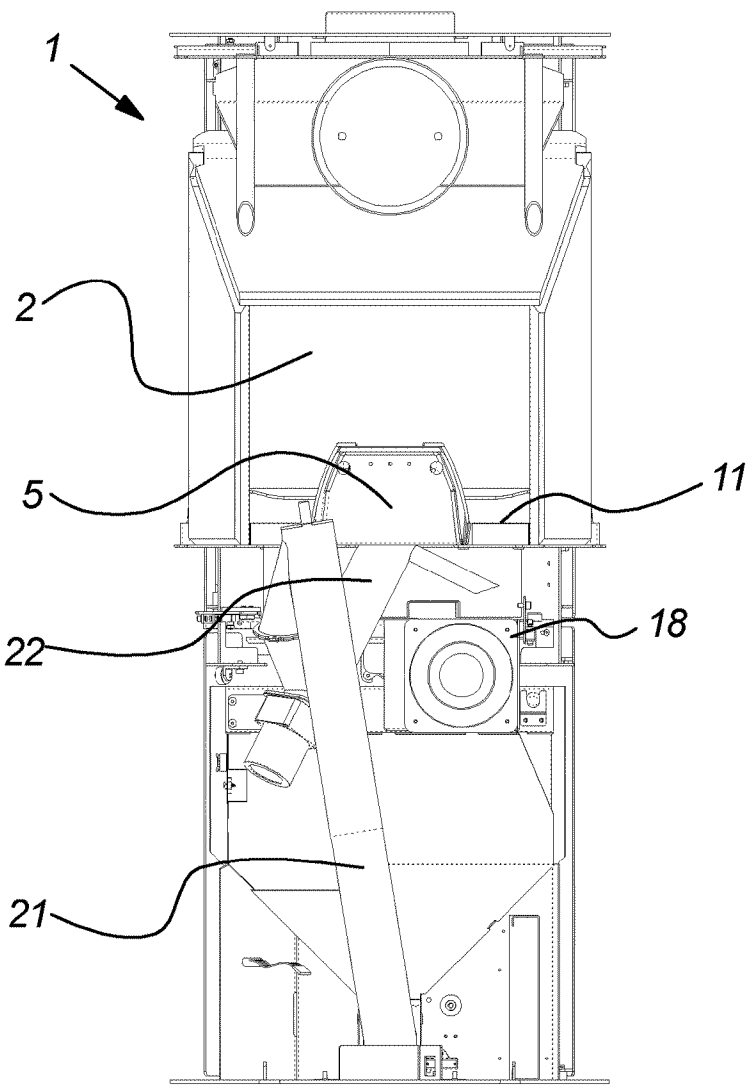
Figure 5:
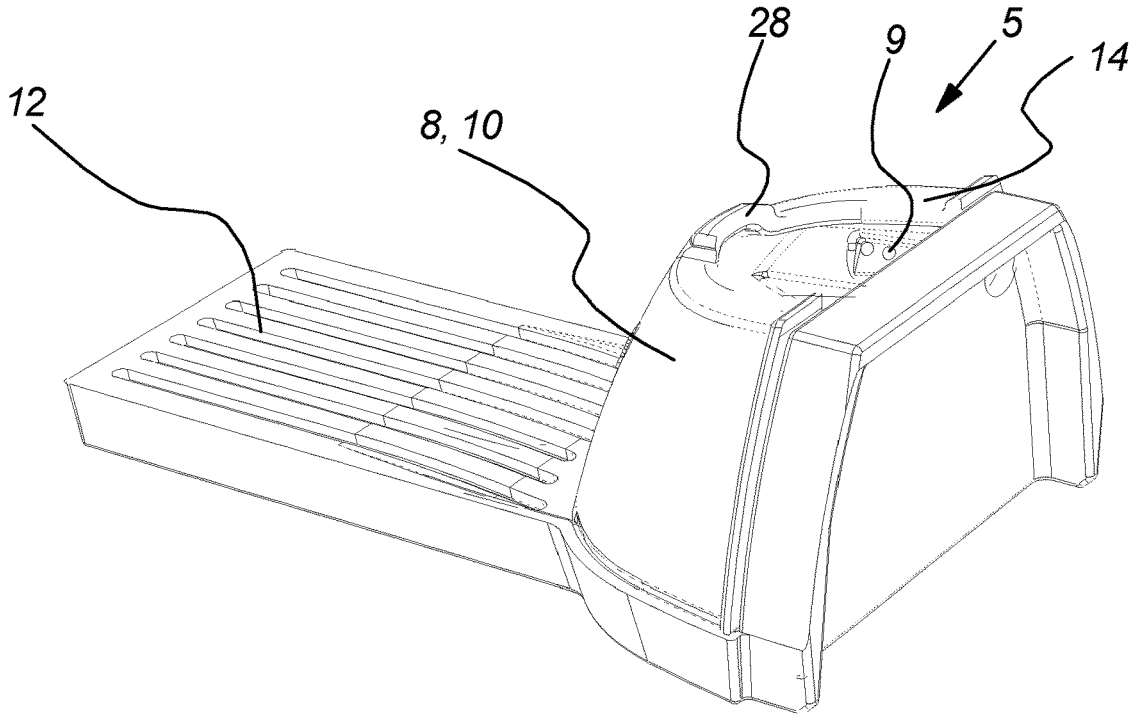
Figure 6:
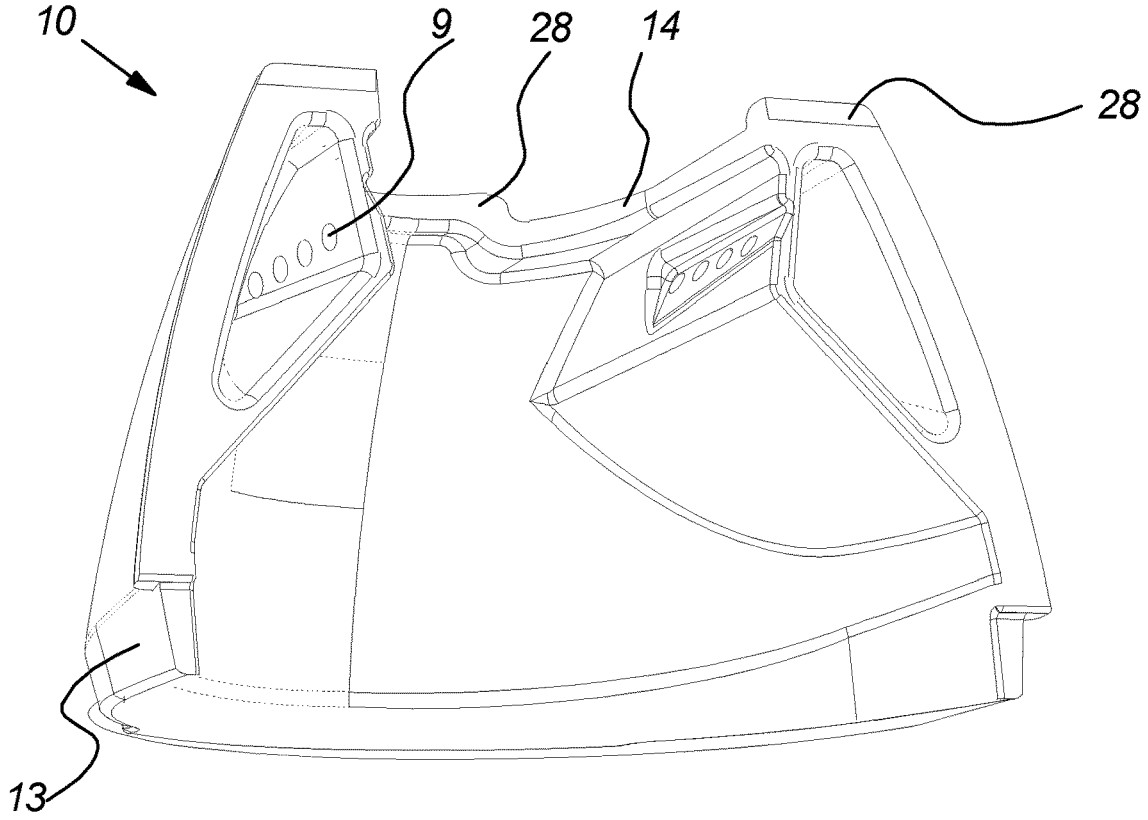
Figure 7:
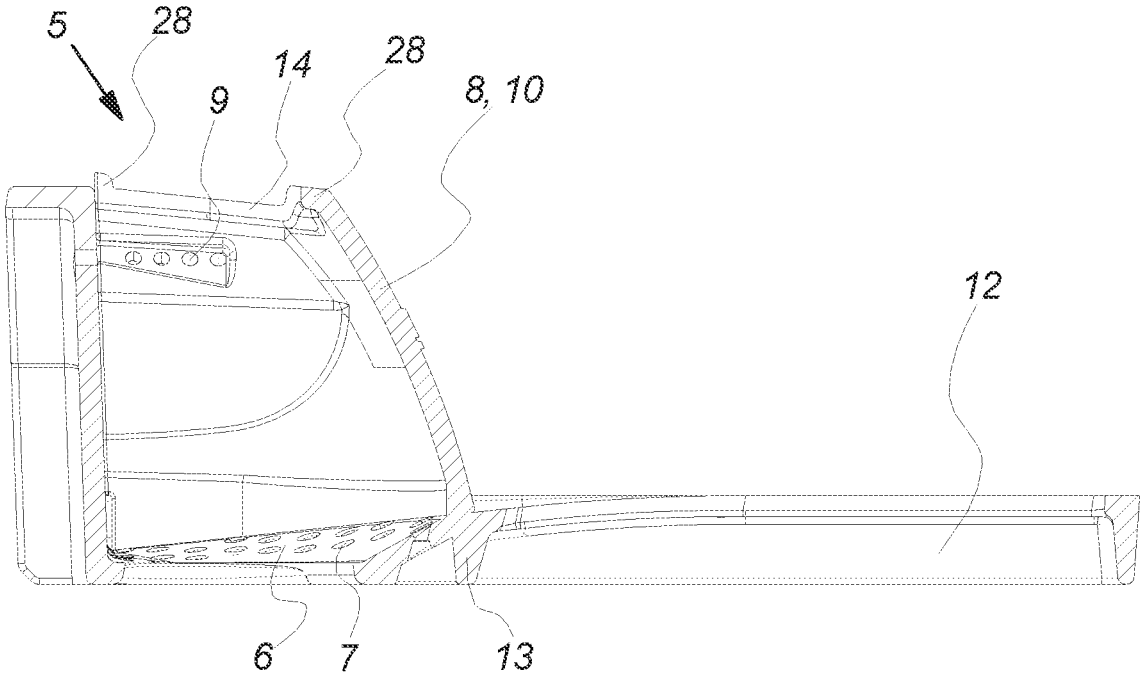
Figure 8:
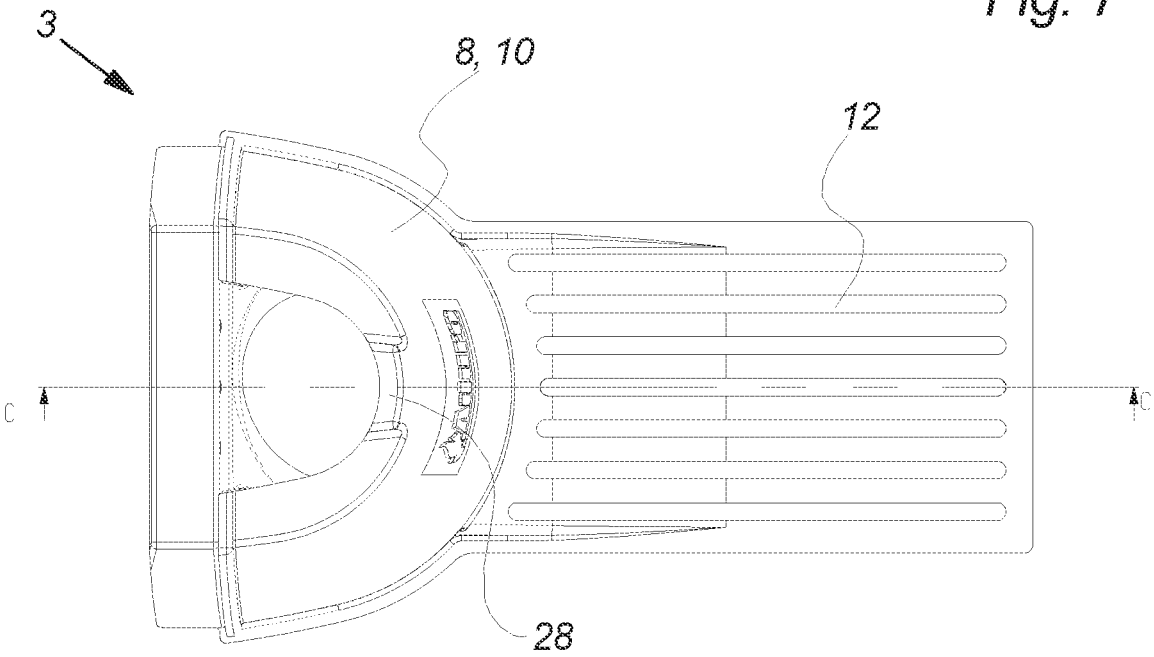

The invention will be described in the following with reference to the figures in which FIG. 1 illustrates a combi stove shown without front cover, as seen in perspective, FIG. 2 illustrates a combi stove shown without back cover, as seen in perspective, FIG. 3 illustrates a combi stove shown without back cover, as seen from the back, FIG. 4 illustrates a cross section through the middle of a combi stove, as seen from the side, FIG. 5 illustrates a granular material combustion area, as seen in perspective, FIG. 6 illustrates the releasable part of the granular material area sidewall, as seen from in perspective, FIG. 7 illustrates a cross section through the middle of a granular material combustion area, as seen from the side, and FIG. 8 illustrates a granular material combustion area, as seen from the top.

DETAILED DESCRIPTION

FIG. 1 illustrates a combi stove 1 shown without front cover, as seen in perspective, FIG. 2 illustrates a combi stove 1 shown without back cover, as seen in perspective, FIG. 3 illustrates a combi stove 1 shown without back cover, as seen from the back and FIG. 4 illustrates a cross section through the middle of a combi stove 1, as seen from the side.

In this embodiment the combi stove 1 comprises a common combustion chamber 2 in which both logs and granular material can be combusted.

In this embodiment granular material is combusted in a granular material combustion area 5, which in this case is arranged at the back of the common combustion chamber 2 so that a log combustion area 11 is formed in front of—and partly around—the granular material combustion area 5. However, in another embodiment the granular material combustion area 5 could be placed elsewhere in the common combustion chamber 2, such as a side, at the front, above or under the log combustion area 11 and/or the granular material combustion area 5 could be placed in more locations in the common combustion chamber 2. And physically separating the granular material combustion area 5 from the log combustion area 11 does not limit the respective combustion processes to the respective areas—e.g. logs could easily be placed (or fall onto) the granular material combustion area 5 so that log combustion would also take place in the granular material combustion area 5.

In this embodiment flue means 17 is arranged above said common combustion chamber 2 but in another embodiment the flue means 17 could be arranged next to or even under the common combustion chamber 2.

In this embodiment ash collecting means 3 in the form of an ash draw is arranged under the combustion chamber 2 so that ash generated in the combustion processes in the common combustion chamber 2 fall down into the ash collecting means 3 by means of gravity—e.g. aided by manual sweeping or scraping.

In this embodiment the combustion chamber 2 and the ash collecting means 3 are—at least partly—separated by a grate 12 ensuring that ash may pass while logs and other larger objects remains in the combustion chamber 2.

In this embodiment the combi stove 1 is also provided with a front aperture 4 through which the combustion chamber 2 may be accessed. The front aperture is so large that logs can pass and thereby be placed in the combustion chamber 2. The front aperture is also used for accessing the granular material combustion area 5 and the log combustion area 11 during cleaning, maintenance, repair and other.

In this embodiment the combi stove 1 is further provided with a door 19 that can be opened or closed by a user and in this embodiment the door 19 is provided with a window 20 to allow that the combustion processes in the combustion chamber 2 may be seen even when the door 19 is closed.

In this embodiment the combi stove comprises a granular material storage 16 arranged entirely beneath the combustion chamber 2 and entirely beneath the ash collecting means 3. However, in another embodiment only parts of the granular material storage 16 would be arranged beneath the combustion chamber 2 and/or the granular material storage 16 or parts of the granular material storage 16 could also or instead be arranged next to or above the common combustion chamber 2.

In this embodiment the combi stove 1 also comprises granular material feeding means 15 arranged for feeding granular material up from the granular material storage 16 and up into the granular material combustion area 5 from beneath.

In this embodiment the granular material feeding means 15 comprises a curving auger 21 arranged to transport the granular material from the bottom of the granular material storage 16 and up near the common combustion chamber 2 where the granular material falls through a down duct 23 and further into an upper auger 22 arranged to feed the granular material the rest of the way up into the common combustion chamber 2. However, it is obvious to the skilled person that the granular material feeding means 15 can be arranged in numerous other way by means of numerous other technical means.

In this embodiment the combi stove 1 is also provided with airflow generating means 18 arranged for actively generating an airflow up through the bottom airflow apertures 7 (see FIG. 7) and the sidewall airflow apertures 9 (see FIG. 6) during the combustion of granular material in the granular material combustion area 5.

In this embodiment the combi stove 1 is formed as a vertical cylinder but it is obvious that in another embodiment the stove 1 could also or instead have another more or less varying cross sectional shape such as triangular, square, rectangular, oval, polygonal or other or any combination thereof.

It should be noticed that any orientation reference made throughout this application—such as top, bottom, up, down, side etc.—in made is relation to the stove 1 during normal orientation and use—i.e. when the stove 1 is arranged to efficiently function as a device for emitting heat generated by a combustion process running inside the stove 1.

FIG. 5 illustrates a granular material combustion area 2, as seen in perspective, FIG. 6 illustrates the releasable part 10 of the granular material area sidewall 8, as seen from in perspective, FIG. 7 illustrates a cross section through the middle of a granular material combustion area 5, as seen from the side and FIG. 8 illustrates a granular material combustion area 5, as seen from the top.

In this embodiment the granular material combustion area 5 is formed integrally with the grate 12 but in another embodiment these parts could be formed completely separate.

In this embodiment the granular material combustion area 5 comprises a bottom combustion surface 6 having a number of bottom airflow apertures 7 arranged to enable an airflow to the granular material during the combustion process inside the granular material combustion area 5.

In this embodiment the granular material combustion area 5 is completely surrounded by a granular material area sidewall 8 which together with the bottom combustion surface 6 forms a burning pot being wider at the bottom than at the top. However, in another embodiment the granular material area sidewall 8 and the bottom combustion surface 6 could be formed in numerous other ways.

In this embodiment a releasable front part 10 of the granular material area sidewall 8 is formed separate and releasable from the granular material combustion area 5 and the rest of the granular material area sidewall 8 so that the granular material combustion area 5, the bottom combustion surface 6 and other may more easily be accessed.

In this embodiment the bottom combustion surface 6 is substantially level with the grate 12 so that when the releasable part 10 of the granular material area sidewall 8 is removed from the granular material area sidewall 8 the bottom combustion surface 6 can easily be cleaned for slag, ash and other and the waste material can easily be swept or pushed out on the grate 12 where it will fall down to the ash collecting means 3.

In this embodiment a bottom part 13 of the releasable part 10 of the granular material area sidewall 8 is provided with a protruding edge arranged to engage a corresponding recess in the bottom combustion surface 6 so that the releasable part 10 of the granular material area sidewall 8 is substantially fixed against displacement in a horizontal plane but can freely be pulled upwards manually and thereby be removed to enable access to the bottom combustion surface 6. However, in another embodiment the releasable part 10 of the granular material area sidewall 8 could be secured against horizontal displacement in relation to the bottom combustion surface 6 in numerous other ways e.g. by means of guide spindles, matching geometry, screws, clamps or other or any combination thereof.

In this embodiment the back part of the granular material area sidewall 8 is formed integrally with the bottom combustion surface 6 so that only around 70% of the bottom combustion surface 6 can be released from the bottom combustion surface 6. But in another embodiment only 60%, 50%, 40% or even less of the granular material area sidewall 8 would be releasable from the bottom combustion surface 6 or 80%, 90% or even 100% of the granular material area sidewall 8 could be releasable from the bottom combustion surface 6.

As best seen in FIG. 6 the releasable part 10 of the granular material area sidewall 8 is in this embodiment provided with sidewall airflow apertures 9 arranged to enable an airflow to the passing flue gasses generated during the combustion process on the bottom combustion surface 6. In this embodiment the sidewall airflow apertures 9 are arranged at the sides along the top edge 14 of the granular material area sidewall 8 but in another embodiment the apertures 9 could also or instead be arranged at the front, further down towards the bottom combustion surface 6 or elsewhere.

As best seen in FIGS. 6 and 7 the fixed back part of the granular material area sidewall 8 is in this embodiment also provided with sidewall airflow apertures 9 and in this embodiment the air flow is guided from the airflow generating means 18 up into the fixed back part of the granular material area sidewall 8 and from there out of the sidewall airflow apertures 9 in the fixed back part and also further on into the releasable part 10 of the granular material area sidewall 8 and thus also out of the sidewall airflow apertures 9. However, it in another embodiment the air flow could be distributed in numerous other ways.

In this embodiment of the invention the top edge 14 of the granular material area sidewall 8 is provided with top edge protrusions 28 ensuring that the top edge 14 is provided with a non-uniform height over the bottom combustion surface 6 so that a log or similar accidentally placed on the granular material combustion area 5 will not hinder or quench the combustion process in the granular material combustion area 5.

The invention has been exemplified above with reference to specific examples of combi stove 1, combustion chamber 2, granular material combustion area 5 and other. However, it should be understood that the invention is not limited to the particular examples described above but may be designed and altered in a multitude of varieties within the scope of the invention as specified in the claims.

LIST

1. Combi stove
2. Combustion chamber
3. Ash collecting means
4. Front aperture
5. Granular material combustion area
6. Bottom combustion surface
7. Bottom airflow apertures
8. Granular material area sidewall
9. Sidewall airflow apertures
10. Releasable part of granular material area sidewall
11. Log combustion area
12. Grate
13. Bottom part of releasable part
14. Top edge of granular material area sidewall
15. Granular material feeding means
16. Granular material storage
17. Flue means
18. Airflow generating means
19. Door
20. Window
21. Curving auger
22. Upper auger
23. Down duct
24.
25.
26.
27.
28. Top edge protrusion

The invention claimed is:

1. A combi stove arranged for combusting both logs and granular material, said combi stove comprising, a common combustion chamber arranged so that both said logs and said granular material may be combusted in said common combustion chamber, an ash collector under said combustion chamber, a front aperture through which logs may be placed in said combustion chamber, a granular material combustion area arranged in said combustion chamber, wherein said granular material combustion area comprises a bottom combustion surface including bottom airflow apertures arranged to enable an airflow to said granular material during a combustion of said granular material in said granular material combustion area, wherein said granular material combustion area is at least partly surrounded by a granular material area sidewall comprising sidewall airflow apertures arranged to enable an airflow to flue gasses generated during a combustion of said granular material in said granular material combustion area, and wherein at least a part of said granular material area sidewall is releasable from said granular material combustion area.

2. The combi stove according to claim 1, wherein said common combustion chamber comprises a log combustion area and wherein said log combustion area is arranged between said front aperture and said granular material combustion area.

3. The combi stove according to claim 2, wherein said log combustion area is separated at least partly from said ash collector by means of a grate.

4. The combi stove according to claim 3, wherein said grate and said bottom combustion surface are substantially level.

5. The combi stove according to claim 1, wherein a bottom part of said releasable part of said granular material area sidewall is arranged to engage said bottom combustion surface to substantially fix said releasable part of said granular material area sidewall against displacement in a horizontal plane.

6. The combi stove according to claim 1, wherein said releasable part of said granular material area sidewall is arranged to surround at least 20% of said granular material combustion area.

7. The combi stove according to claim 1, wherein said sidewall airflow apertures are arranged at a top edge of said granular material area sidewall.

8. The combi stove according claim 1, wherein said combi stove comprises a granular material feeder arranged for feeding granular material up into said granular material combustion area from beneath said granular material combustion area during a combustion of said granular material in said granular material combustion area.

9. The combi stove according to claim 1, wherein said combi stove comprises a granular material storage arranged beneath said combustion chamber.

10. The combi stove according to claim 1, wherein said combi stove comprises a flue arranged above said combustion chamber.

11. The combi stove according to claim 1, wherein said combi stove comprises an airflow generator for actively generating an airflow through said bottom airflow apertures and said sidewall airflow apertures at least during a combustion of said granular material.

12. The combi stove according to claim 1, wherein a top edge of said granular material area sidewall is formed with a non-uniform height over said bottom combustion surface.

13. The combi stove according to claim 1, wherein said granular material is wood pellets.

14. Use of the combi stove according to claim 1 for combusting wood logs and wood pellets.

15. The combi stove according to claim 1, wherein said releasable part of said granular material area sidewall is arranged to surround preferably at least 30% of said granular material combustion area.

16. The combi stove according to claim 1, wherein said releasable part of said granular material area sidewall is arranged to surround most preferred at least 45% of said granular material combustion area.

* * * * *